US008274023B2

(12) United States Patent
Gazard

(10) Patent No.: US 8,274,023 B2
(45) Date of Patent: Sep. 25, 2012

(54) MISSILE TRAINING SYSTEM

(75) Inventor: Philip Neil Gazard, Bath (GB)

(73) Assignee: MBDA UK Limited, Hertfordshire (GB)

( * ) Notice: Subject to any disclaimer, the term of this patent is extended or adjusted under 35 U.S.C. 154(b) by 332 days.

(21) Appl. No.: 12/443,789

(22) PCT Filed: Feb. 19, 2009

(86) PCT No.: PCT/GB2009/050160

§ 371 (c)(1),
(2), (4) Date: Mar. 31, 2009

(87) PCT Pub. No.: WO2009/104015

PCT Pub. Date: Aug. 27, 2009

(65) Prior Publication Data

US 2010/0270418 A1 Oct. 28, 2010

(30) Foreign Application Priority Data

Feb. 21, 2008 (EP) ..... 08200007
Feb. 21, 2008 (GB) ..... 0803175.9

(51) Int. Cl.
*F42B 15/01* (2006.01)
*F42B 15/00* (2006.01)

(52) U.S. Cl. ..... 244/3.1; 89/1.1; 89/1.11; 244/1 R

(58) Field of Classification Search ..... 244/3.1–3.3, 244/1 R, 158.1, 158.4, 158.6, 158.8; 89/1.1, 89/1.11; 342/42–45, 52–55, 61–68, 89, 90, 342/175, 195; 102/200, 206, 211–215, 221, 102/382, 384, 386, 387
See application file for complete search history.

(56) References Cited

U.S. PATENT DOCUMENTS 3,738,593 A * 6/1973 Duvall ..... 244/3.14
3,949,954 A * 4/1976 Lipsey ..... 244/3.15
4,315,609 A * 2/1982 McLean et al. ..... 244/3.14
4,420,129 A * 12/1983 Stetter ..... 244/3.15

(Continued)

FOREIGN PATENT DOCUMENTS

DE 102 20 440 C1 12/2003

(Continued)

OTHER PUBLICATIONS

International Preliminary Report on Patentability dated Nov. 18, 2010.

*Primary Examiner* — Bernarr Gregory
(74) *Attorney, Agent, or Firm* — Scully, Scott, Murphy & Presser, PC

(57) ABSTRACT

The present invention is directed to missile training systems, especially to those relating to the provision of a mechanism that allows missiles and similar devices to be fired at a target in a realistic, but safe, manner. The use of live fire exercises, in which army or other armed forces personnel use fully functioning weapons systems is well established. Live fire exercises can be used to provide realistic training scenarios, but also present obvious dangers. The present invention provides a module for attachment to an object (such as a missile), the object being adapted to be directed towards a target (such as a ship), the module comprising a control system providing an output signal indicative of whether or not said object is to be destroyed.

23 Claims, 4 Drawing Sheets

U.S. PATENT DOCUMENTS

| | | | | | |
|---|---|---|---|---|---|
| 4,934,269 | A | * | 6/1990 | Powell | 102/221 |
| 4,972,775 | A | * | 11/1990 | Hoyt et al. | 102/211 |
| 5,067,674 | A | * | 11/1991 | Heyche et al. | 244/3.14 |
| 5,131,602 | A | * | 7/1992 | Linick | 244/3.14 |
| 5,260,709 | A | * | 11/1993 | Nowakowski | 342/62 |
| 5,689,420 | A | * | 11/1997 | Brewster | 102/215 |
| 5,696,347 | A | * | 12/1997 | Sebeny et al. | 102/214 |
| 6,058,338 | A | * | 5/2000 | Agashe et al. | 244/158.8 |
| 6,142,411 | A | * | 11/2000 | Cobleigh | 244/3.14 |
| 6,293,202 | B1 | * | 9/2001 | Woodall et al. | 102/387 |
| 6,795,174 | B1 | * | 9/2004 | Miller | 244/3.11 |
| 6,796,213 | B1 | * | 9/2004 | McKendree et al. | 89/1.11 |
| 6,896,220 | B2 | | 5/2005 | McKendree | |
| 6,906,659 | B1 | * | 6/2005 | Ramstack | 342/54 |
| 6,952,001 | B2 | | 10/2005 | McKendree | |
| 7,021,187 | B1 | | 4/2006 | Grassi | |
| 7,207,517 | B2 | * | 4/2007 | McKendree et al. | 244/3.15 |
| 7,312,744 | B1 | * | 12/2007 | Ramstack | 342/54 |
| 7,367,525 | B2 | * | 5/2008 | McKendree et al. | 244/3.15 |
| 7,370,584 | B2 | * | 5/2008 | Johnson et al. | 102/221 |
| 2004/0233097 | A1 | * | 11/2004 | McKendree et al. | 342/62 |

FOREIGN PATENT DOCUMENTS

| | | | | |
|---|---|---|---|---|
| FR | 2 618 541 | | | 1/1989 |
| GB | 2 211 371 | A | | 6/1989 |
| JP | 4-222400 | | | 8/1992 |
| JP | 6-94399 | | | 4/1994 |
| JP | 2004-347195 | | | 12/2004 |
| JP | 2005-67556 | A | * | 3/2005 |
| RU | 2 191 343 | C2 | | 4/2002 |
| WO | WO 00/03193 | | | 1/2000 |

* cited by examiner

MISSILE TRAINING SYSTEM

The present invention is directed to missile training systems. In particular, the present invention is directed to the provision of a mechanism that allows missiles and similar devices to be fired at a target in a realistic, but safe, manner.

BACKGROUND OF THE INVENTION

The use of live fire exercises, in which army or other armed forces personnel use fully functioning weapons systems, is well established. Live fire exercises can be used to provide realistic training scenarios, but also present obvious dangers. Live fire exercises present opportunities for checking that weapons systems function correctly and allow users, such as soldiers, to practice using real weapons in situations that are more realistic than firing ranges. Also, training with live ammunition prevents the situation where a soldier's first experience of live firing is in a real combat situation from occurring.

Live fire exercises are not limited to army training exercises. Other branches of the armed forces use live fire exercises and the principles can be extended to other situations, including civilian applications.

It is known to use live missiles and torpedoes in naval training exercises and trials. For example, missiles can be fired at a ship to check the effectiveness of mechanisms for tracking and destroying such missiles. Clearly, there are substantial safety and costs issues to address before such a live firing regime is likely to be approved.

A first known approach for firing live missiles at a ship involves the use of a dummy ship. Such a ship may be fitted with appropriate anti-missile technology, but crucially requires no personnel to be on board, thereby eliminating the risk to human life. This approach has two clear disadvantages. First, if the anti-missile defences are unsuccessful, the dummy ship is likely to be damaged. This would be expensive, particularly if sophisticated defensive weapons systems are damaged. A second disadvantage with this system is that if no personnel are on-board, then there is no exposure of such personnel to the effects of an in-coming missile.

A second known approach is to use over-firing; such an arrangement is shown in FIG. 1. FIG. 1 shows a ship 10 and a missile launch site 12. The trajectory of the missile is indicated by the curve 14. During the exercise, the anti-missile defences of the ship 10 attempt to destroy the missile using an anti-missile weapon, indicated schematically by the arrow 16. If the anti-missile defences of the ship 10 are ineffective, the missile continues over the ship and lands harmlessly, as indicated by the trajectory 18.

Thus, over-firing involves firing a missile or other projectile at a target, such as a ship, so that the missile or projectile passes over the ship and lands safely on the other side. This approach enables personnel to be on board the ship and enables the on-board systems to be used in a realistic manner to attempt to destroy the incoming missile. However, the increased realism provided by enabling personnel to stay on board is tempered by the absence of the reality of the missile approaching the ship.

A third approach is to direct a missile towards a ship but to program its route so that it moves away from the ship during the later stages of its approach. FIG. 2 shows such an arrangement, including a ship 20 and a missile launch site 22. A missile is fired along trajectory 24 that initially directs the missile towards the ship 20. The anti-missile technology of the ship has an opportunity to destroy the missile as indicated schematically by the arrow 26. If the anti-missile technology is not effective to destroy the missile, the trajectory 24 is programmed such that missile moves away from the ship in a safe manner, as shown in FIG. 2.

Again, the arrangement described with reference to FIG. 2 lacks realism. Furthermore, many existing pre-programmed or remote control systems use missiles or other vehicles/objects that operate much more slowly than "real" incoming missiles and often have a larger size and a different visual, radar, electronic and thermal signature, thereby reducing the realism of the exercise. A further problem with such programming is that the guidance software may need to be disclosed to third parties using or developing the missile training system; this may be unacceptable for national security reasons.

A problem common to many prior art arrangements is their inability to test for "soft kill" defences. The principle of "soft kill" defences is shown in FIG. 3. A ship 30 is provided and a missile launched from a launch site 32 along trajectory 34 that initially is targeted at the ship 30. Once the missile is detected by the ship 30, a decoy 36 is deployed. The decoy could take many different forms as is well known in the art. The purpose of the decoy is to convince the missile's guidance systems that the decoy 36 is in fact the ship 30. Thus, the missile's trajectory 34 is adjusted so that the missile is directed towards the decoy 36.

Pre-programmed missiles such as that described with reference to FIG. 2 are simply unable to react to soft-kill defences; thus, they cannot be used to test the effectiveness of such defences.

The present invention seeks to address at least some of the problems identified above.

BRIEF SUMMARY OF THE INVENTION

The present invention provides a module for attachment to an object (such as a missile), the object being adapted to be directed towards a target (such as a ship), the module comprising a control system providing an output signal indicative of whether or not said object is to be destroyed. The module is generic in design allowing the object to take a variety of forms. The object is destroyed if one of a number of conditions is not met.

The present invention also provides a method comprising the steps of: directing an object (such as a missile) towards a target (such as a ship), the object having a module attached thereto; determining the position of the module using a combination of position detectors (which may be located within the module); and using the module to destroy the object if one of a number of conditions is not met.

The present invention also provides a method comprising the steps of: directing an object (such as a missile) towards a target (such as a ship), the object and target each having a module attached thereto; determining the position of the module using a combination of position detectors. Embodiments of the invention include using the module to inform the persons aboard the ship or sending a radio signal to the module attached to the object if one of a number of conditions is not met.

The object in question may be a missile, torpedo or a similar object or projectile. The object may be fired at the target. The missile may be a conventional missile with its warhead removed. By using a real missile, the realism of any exercise is enhanced; for example, real missiles move in ways that may not be easily replicated by dummy missiles, particularly if the control system of the real missile is not available.

Thus, the present invention addresses problems outlined above concerning the testing missile defence systems and the provision of live fire exercises by providing missiles that can be fired at a ship in a conventional manner. The inherent dangers with such a system are reduced by providing a mechanism for destroying the missile before it reaches the target. Thus, the present invention provides a simple, elegant means for enabling a real missile or a similar object to be used to provide a realistic battlefield scenario, whilst providing means for destroying the missile before it is able to reach the target in question.

The provision of a generic module, such as a pod, that can be attached to a missile or similar object enables the use of obsolete missiles and/or the manufacture of missiles to obsolete designs for the purpose of training exercises, thereby providing cheap, reliable and relatively realistic training scenarios. In this way, many missiles reaching the end of their in-service life could be used as training missiles.

The control system may be adapted to set said output signal to indicate that said object is to be destroyed if one of a number of conditions is not met. Exemplary conditions include the position of the object, the speed of travel of the object and the duration of travel of the object. In one embodiment of the invention, one of said conditions is whether said object is positioned within an allowed zone. The allowed zone is defined as a three dimensional corridor about the anticipated path of the object (e.g. using a series of waypoints). In embodiments of the invention including two or more position sensor systems, the control system may indicate that the object should be destroyed if any position sensor system indicates that the object is outside an allowed zone.

A position detector may be provided for providing position data to said control system. The position detector comprises two or more independent position detector systems. Exemplary position detector systems include various satellite-based systems (such as GPS and Galileo) but there are many alternative positioning systems that could be used (such as inertial and proximity sensor systems). An advantage of using multiple position detector systems is the provision of added confidence in the position data; this confidence is further increased if the various position systems are independent and function in a different manner.

A single position signal may be generated in response to the data from the various position detector systems that are used. This simplifies the design and functionality of the remainder of the system. The algorithm used to provide a single position signal in response to a number of position data inputs may take account of confidence data associated with the various position data inputs.

The module may include a mechanism for destroying said object. In some implementations of the invention, the destruction mechanism may be dependent on the object that is being destroyed. Indeed, the destruction mechanism may be one of the few (possibly the only) bespoke elements of the module.

A transmitter for transmitting data, such as position data, to a central server may be provided. Recording position data enables the movement of the object to be tracked and, in the case of a missile or similar object that is fired at a ship or the like, enables a complete three-dimensional reconstruction of an engagement to be generated. The tracking of position by recording the output of the position sensor(s) of the module is relatively straightforward and typically much simpler and cheaper than providing full telemetry data. Tracking position data enables the effectiveness of soft kill defences to be monitored. The module may include a receiver for receiving data from a central server in addition to, or instead of, a transmitter. The receiver may, for example, receive) position data and/or destruction instructions; for example, such data or instructions may be transmitted from the target or a module attached to the target.

The module may be provided with means for mechanical attachment to the said object. The mechanical attachment may be extremely simple; for example, a jubilee clip might be provided. The mechanical attachment may be dependent on the object with which the module is intended to be used.

The present invention further provides a method comprising the steps of: directing an object (such as a missile or some other projectile) at a target (such as a ship); determining the position of the object using a position detector (for example, using a module or pod attached to the object); and transmitting data concerning the position of the module to a remote server. The method may be used for providing a battlefield simulation.

The method may further comprise the step of destroying the object if one of a number of conditions is not met. For example, allowed and disallowed zones for the object may be defined, with the step of destroying the object being activated if the object is within a disallowed zone. The step of destroying the object may be implemented using a module attached to the object.

BRIEF DESCRIPTION OF THE DRAWINGS

Embodiments of the invention will now be described with reference to the accompanying schematic drawings of which.

DETAILED DESCRIPTION

Figure 1:
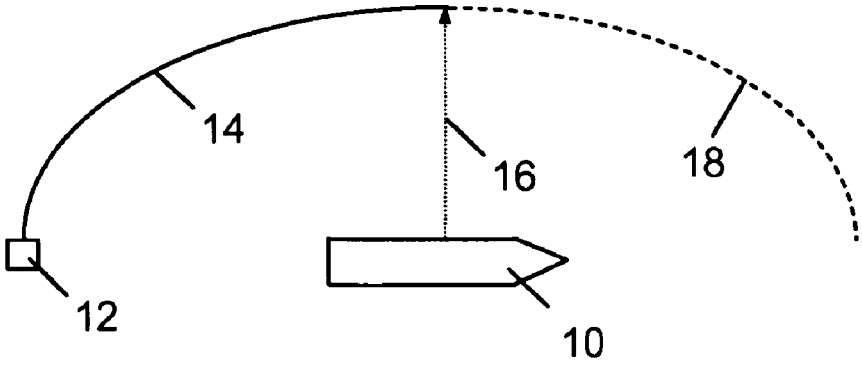
FIG. 1 shows a first known live firing arrangement that makes use of over-firing.
Figure 2:
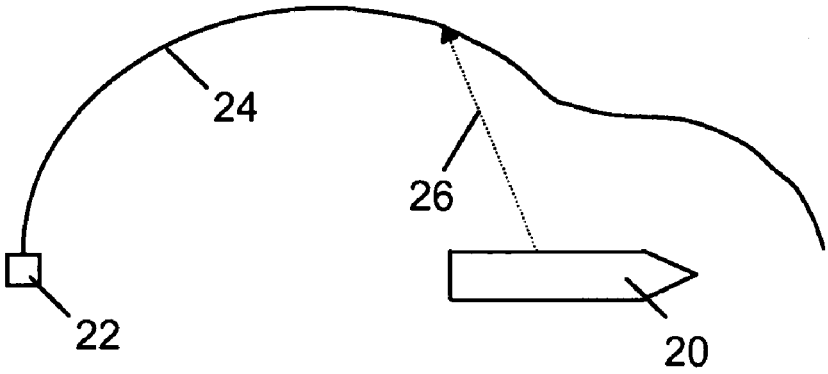
FIG. 2 shows a second known live firing arrangement.
Figure 3:
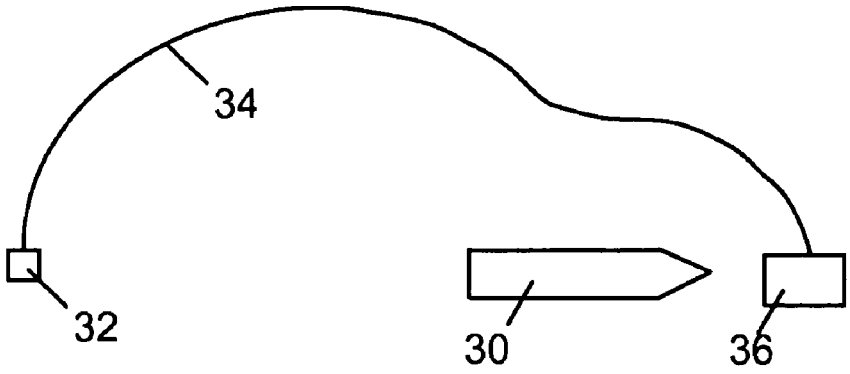
FIG. 3 demonstrates the principle of soft kill.
Figure 4:
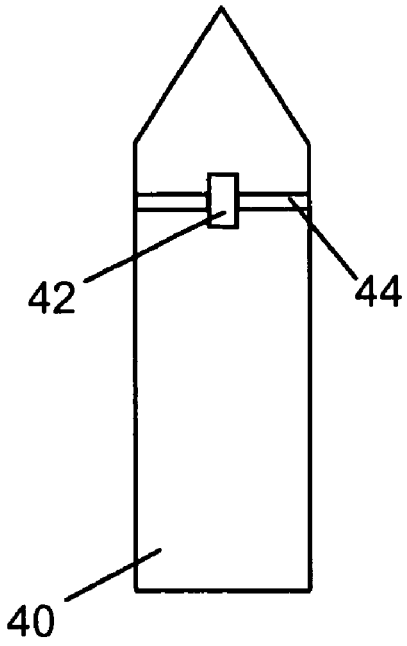
FIG. 4 is a schematic representation of a missile incorporating a pod in accordance with an aspect of the present invention.

FIG. 4 shows a missile 40 having a pod 42 attached thereto using an attachment means 44. The pod is provided to destroy the missile in the event that one of a number of conditions is not met, as described in detail below.

Figure 5:
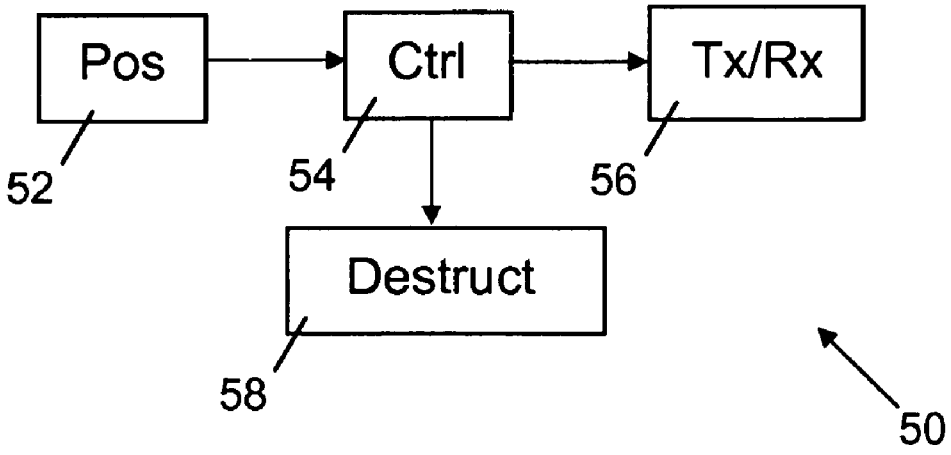
FIG. 5 is a block diagram showing features of the present invention.

FIG. 5 is a block diagram of a control system that can be used to destroy the missile 40. The system, indicated generally by the reference numeral 50, comprises a position sensor 52, a controller 54, a transceiver 56 and a destruct mechanism 58. The destruct mechanism 58 is used to destroy the missile when instructed to do so by the controller 54.

The controller 54 receives position data from position sensor 52. On the basis of the position data, the controller determines whether the missile is in a safe position. If it is, the controller simply allows the missile to proceed as normal. As soon as the missile is deemed to be in an unsafe position, the controller instructs the destruct mechanism 58 to destroy the missile.

The destruction of the missile can be achieved in a variety of ways. One exemplary method is to use a break-up explosive charge within the pod that when fired is sufficient to cause the missile to break-up, thereby ensuring that it stops flying as quickly as practicable. Further methods are known to persons skilled in the art.

In addition, the controller 54 is able to receive data from transceiver 56. The transceiver may, for example, receive instructions from a transmitter to destroy the missile. The transceiver 56 can also be used to transmit position and other data from the controller 54 to a remote server as discussed further below.

It should be noted that although the transceiver 56 may be able to receive data instructing the control system 50 to destroy the missile, this is unlikely to be sufficiently reliable to be used as the primary mechanism for destroying the missile. Nevertheless, it could provide a useful backup system. By way of example, a signal might be received at the transceiver to destroy the missile in the event of a failure at the ship and the consequential aborting of the exercise.

In most control algorithms in accordance with the invention, it is a requirement that the position of the missile to be known to a high degree of certainty. In order for the system to be deployed, it is necessary to have a high degree of confidence in the position sensor 52.

Figure 6:
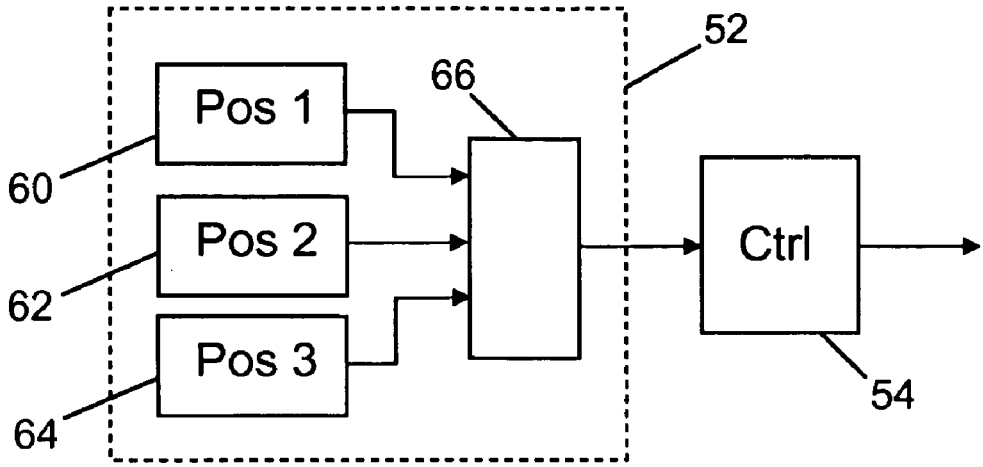
FIG. 6 is a block diagram showing position determining means in accordance with an aspect of the present invention.

In practice, it is desirable to have a number of independent position sensors operating in parallel. Such an arrangement is shown in FIG. 6. The arrangement of FIG. 6 includes the position sensor 52 and controller 54 of the system 50. As shown in FIG. 6, the position sensor 52 includes a first position sensor 60, a second position sensor 62 and a third position sensor 64, each having an output coupled to an input of a circuit 66. The circuit 66 converts the position data from the sensors 60, 62 and 64 into a single position data signal that is provided to the controller 54. The circuit 66 may function in one of a number of ways. For example, the circuit 66 may provide a simple average position. Alternatively, the circuit 66 may provide an average, but omitting any data signal that is significantly different to the others.

In one exemplary control algorithm, in the event that any of the position sensors indicates that the missile is in an unsafe position, the missile is destroyed under the control of the controller 54.

In a more sophisticated arrangement, the outputs of the first 60, second 62 and third 64 position sensors includes data concerning the reliability of that data. The controller then determines a single position signal on the basis of the three position inputs, with the degree of confidence in each data input being used to determine the weight to apply to that data input. Alternatively, the circuit 66 may select the most reliable position data, or may average all data inputs that are above a predetermined reliability threshold. Other algorithms are possible which take into full account the characteristics of each position input to minimise errors.

The position sensors may use a Global Position Navigation System, such as the well known Global Positioning System (GPS). In order to provide additional reliability, the first 60, second 62 and third 64 position sensors may use different Global Position Navigation Systems; for example, the first position sensor 60 may be a Global Positioning System, the second position sensor may) be a GLONASS system and the third position system 64 may be a Galileo positioning system.

In addition to providing additional reliability by providing different satellite positioning systems, one or more of the position sensors may implement a different technology. For example, one of the position sensors may be inertial, dead-reckoning system that measures the distance traveled from a known starting position. Other alternatives include the use of a proximity sensor indicating the actual distance of the missile from the target. Suitable radar proximity sensors are known. An alternative proximity sensor uses the strength of a transmitted electrical signal as an indicator of distance. Of course, many alternative positioning systems that could be used in the present invention will be known to persons skilled in the art.

Figure 7:
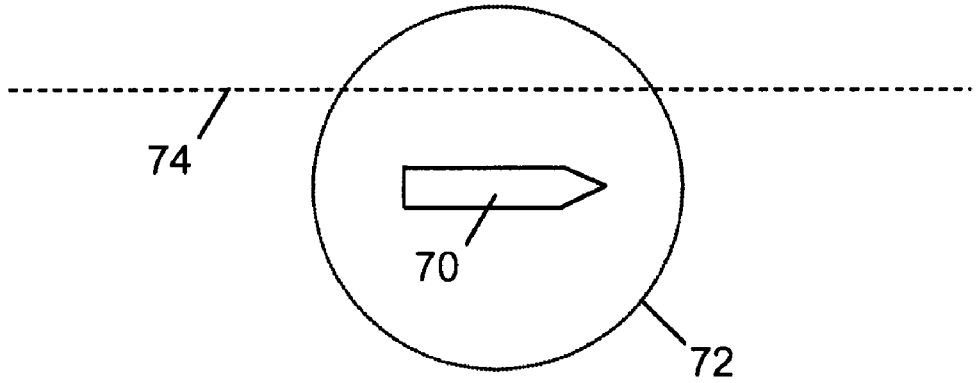
FIG. 7 demonstrates an aspect of the use of the present invention.

As indicated above, the controller 54 is adapted to instruct the destruct mechanism to destroy the missile when the missile is deemed to be in an unsafe area. FIG. 7 demonstrates one definition of an unsafe zone.

FIG. 7 shows a ship 70. The ship 70 has a missile defence system that has a known operational range. That range defines an area in which incoming missiles should be destroyed and is shown by the dotted line 72 in FIG. 7. In order for the missile defence system to be tested, an incoming missile should be allowed to enter into the zone 72 but should not be allowed to move sufficiently close to the ship 70 to pose a risk.

A line 74 is shown in FIG. 7. The line 74 indicates the boundary of acceptable and unacceptable areas for the missile to be in. Should the missile move below the line 74, the missile is destroyed under the control of the controller 54.

Figure 8:
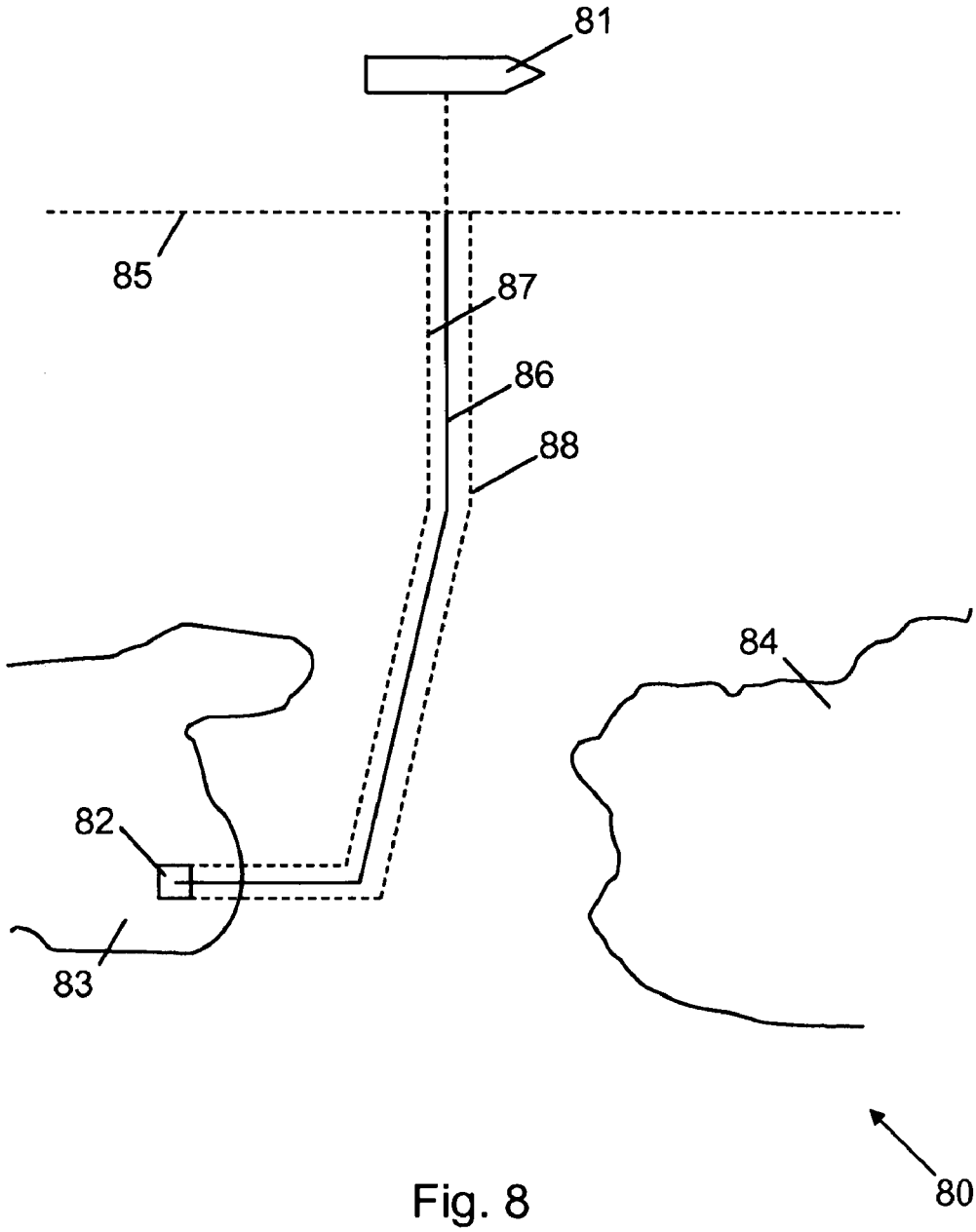
FIG. 8 demonstrates a further aspect of the use of the present invention.

FIG. 8 shows a more sophisticated scenario, indicated generally by the reference numeral 80. The scenario 80 includes a ship 81, a missile launch site 82 and land areas 83 and 84. The land areas may be real land or may be simulated land. As in the example of FIG. 7, a safe zone is defined by a line 85; should a missile be above of the line 85, it is destroyed under the control of the controller 54.

In the scenario 80, a missile is given a predetermined route 86. Plotting a route enables the missile to avoid the areas of land 83 and 84. A safe corridor is defined around the route 86 as shown by the dotted lines 87 and 88. If the position sensors determine that the missile is outside the defined corridor, then the missile is destroyed.

The size of the safe corridor may be variable. For example, tighter tolerances may be required as the missile gets closer to the ship. Also, tighter tolerances may be desirable if the missile is over land. Further, in some embodiments of the invention, the altitude of the missile may be required to be within a given range; again, the tolerance of allowable altitude range might be variable.

Furthermore, position sensor redundancy may be provided such that should any of a plurality of navigation systems indicate that the missile is outside of the safe corridor, the missile is destroyed.

As discussed above with reference to FIG. 4, the destruct mechanism and its associated control system are provided in a module that is separate to the missile. One such arrangement provides a pod that is attached to the missile in some way, such as by using a simple jubilee clip. An advantage of providing a separate module in this manner is that the control system for the module can be completely separate to the control system for the missile itself. In such an arrangement, there would be no need to understand the control system of the missile itself (and therefore no need for access of control algorithms); this would enable a missile to be used even if the details of missile control system were not known, for example if they were classified. Also, the pod algorithm can be kept simple, and therefore relatively safe and reliable.

As discussed above with reference to FIG. 5, the control module may be provided with means to transmit position data to a remote server. Such an arrangement enables the movement of the missile to be tracked and enables the engagement to be reconstructed. This might be useful, for example, to determine whether or not (or the extent to which) a soft kill decoy was successful in altering the course of the missile. It should be noted that transmitting position data is relatively straightforward and certainly much simpler than attempting to access detailed telemetry data that might be generated by the control system of the missile itself, which telemetry data may simply be unavailable for testing purposes.

The present invention has been described using missiles being fired at a ship as an example; however, the invention is not so limited. The concepts described are readily applicable to sea-skimming, anti-ship missiles, but can also be applied to land-attack cruise missiles approaching and attempting to cross an air-defence zone protected by ground launched anti-air missiles. It would also be possible to apply the principles of the invention to anti-air missiles against manned aircraft where vertical (altitude) separation can be used to maintain safety, although due to the generally smaller size of such missiles and more demanding aerodynamic requirements, the control system of the present invention may need to be incorporated internally, rather than as an externally mounted module.

In the exemplary applications outlined above, a missile is destroyed in the event that the position of the missile is outside a defined area or range. However, there are other parameters that could be used to trigger the destruction of the missile or other object, in addition to, or instead of, the position of the object. Possible parameters include: the lateral displacement of the object from a planned track, the time of flight of the object, the early or late arrival of the object at a predetermined position, the altitude of the object, and the total distance traveled.

As noted above, it is important that the systems of the present invention are reliable; accordingly, the use of redundancy is attractive. One form of redundancy is to provide more than one position sensor, so that the control system is not reliant of a single input. Another form of redundancy is to provide two entirely separate position control systems, which may have the same or different inputs. The separate control systems can each be used to generate a position output. Additional reliability can be obtained by having different design teams implementing the different systems; in extreme examples, the different design teams may be provided by different companies. In some examples, the design teams may provide different algorithms that use the same data inputs: in other examples, the data inputs themselves might be different.

As discussed above, the present invention is directed to the provision of a mechanism that allows missiles and similar devices to be fired at a target in a realistic, but safe, manner. The invention also has application for system development and proving trials for offensive, defensive and surveillance systems.

The invention claimed is:

1. A generic module for external attachment to a missile, torpedo or other projectile, the missile, torpedo or other projectile being configured for directing towards a target in testing of missile defence systems or live fire exercises, the module comprising:

a position detector for providing position data;

a mechanism for destroying said missile, torpedo or other projectile; and a control system configured to receive said position data from the position detector and to provide an output signal to the mechanism for destroying the missile, torpedo or other projectile to cause said mechanism to destroy the missile, torpedo or other projectile if the position detector indicates that said missile, torpedo or other projectile is in an unsafe position.

2. A module as claimed in claim 1, wherein the control system is configured to provide the output signal if the missile, torpedo or other projectile is not positioned within an allowed zone, the zone being defined according to an anticipated path of the missile, torpedo or other projectile.

3. A module as claimed in claim 1, wherein said position detector comprises two or more independent position detector systems.

4. A module as claimed in claim 3, further comprising means for providing a single position signal in response to data from the said two or more independent position detector systems.

5. A module as claimed in claim 4, wherein the control system is arranged to provide the output signal if the missile, torpedo or other projectile is not positioned within an allowed zone, the zone being defined according to an anticipated path of the missile, torpedo or other projectile.

6. A module as claimed in claim 1, further comprising a transmitter for transmitting data to a central server.

7. A module as claimed in claim 6, wherein said data includes position data.

8. A module as claimed in claim 1, further comprising means for mechanically attaching the module to said missile, torpedo or other projectile.

9. A system comprising a module as claimed in claim 1, and further comprising the missile, torpedo or other projectile, in which the module and the missile, torpedo or other projectile are connected by a connection that is solely mechanical.

10. A method comprising the steps of:

directing a missile, torpedo or other projectile towards a target, the missile, torpedo or other projectile having a module externally attached thereto;

determining by using a control system of the module the position of the module using position data received from a position detector of the module, the position detector comprising two or more position sensors, the control system generating and sending a signal to the module for destroying the missile, torpedo or other projectile if the missile, torpedo or other projectile is in an unsafe position.

11. A method as claimed in claim 10, further comprising the steps of defining allowed and disallowed zones for said missile, torpedo or other projectile, wherein the signal for destroying the missile, torpedo or other projectile is activated if the missile, torpedo or other projectile is within a disallowed zone.

12. A method as claimed in claim 10, wherein the step of determining the position of the module includes the step of using two or more independent position detector systems.

13. A method as claimed in claim 12, wherein the step of using said module to destroy the missile, torpedo or other projectile is carried out if any of said position detector systems indicate that the missile, torpedo or other projectile is in a disallowed zone.

14. A method as claimed in claim 12, wherein the step of determining the position of the module comprises outputting a single position signal in response to data from the said two or more independent position detector systems.

15. A method as claimed in claim 10, further comprising the step of transmitting data to a central server.

16. A method as claimed in claim 15, wherein said data includes position data.

17. A method as claimed in claim 10, further comprising the step of mechanically attaching the module to said missile, torpedo or other projectile.

18. A method comprising the steps of:

directing a missile, torpedo or other projectile at a target;

determining the position of the missile, torpedo or other projectile using a position detector;

transmitting data concerning the position of the missile, torpedo or other projectile to a remote server; and destroying the missing, torpedo or other projectile if one of a number of conditions is not met.

19. A method as claimed in claim 18, further comprising the step of attaching a module to the missile, torpedo or other projectile.

20. A method as claimed in claim 19, further comprising the step of using said module to obtain the said position of the missile, torpedo or other projectile.

21. A method as claimed in claim 19, wherein the step of destroying the missile, torpedo or other projectile is carried out by use of the module to destroy the missile, torpedo or other projectile.

22. A method as claimed in claim 18, further comprising the step of defining allowed and disallowed zones for said missile, torpedo or other projectile, wherein the step of destroying the missile, torpedo or other projectile is activated if the missile, torpedo or other projectile is within a disallowed zone.

23. A method as claimed in claim 18, wherein the step of the determining the position of the missile includes the step of using two or more independent position detector systems.

* * * * *